US007001311B2

(12) United States Patent
Frank

(10) Patent No.: US 7,001,311 B2
(45) Date of Patent: Feb. 21, 2006

(54) PLAYGROUND EQUIPMENT

(75) Inventor: John Frank, Odense (DK)

(73) Assignee: Kompan A/S, Ringe (DK)

( * ) Notice: Subject to any disclaimer, the term of this patent is extended or adjusted under 35 U.S.C. 154(b) by 972 days.

(21) Appl. No.: 09/805,739

(22) Filed: Mar. 13, 2001

(65) Prior Publication Data

US 2002/0010061 A1 Jan. 24, 2002

(30) Foreign Application Priority Data

Mar. 13, 2000 (DK) ..... 2000 00400
Mar. 24, 2000 (DK) ..... 2000 00500

(51) Int. Cl.
*A63B 21/00* (2006.01)

(52) U.S. Cl. ..... 482/35; 104/74; 104/76
(58) Field of Classification Search ..... 482/28, 482/29, 35, 27; 104/74, 75, 76, 77, 78
See application file for complete search history.

(56) References Cited

U.S. PATENT DOCUMENTS 2,730,336 A 1/1956 Etherington
2,989,308 A * 6/1961 Diehl
3,749,399 A 7/1973 Fedor et al.
4,389,047 A * 6/1983 Hall
4,877,236 A 10/1989 Shannon
5,125,361 A * 6/1992 Rowlands
5,328,422 A * 7/1994 Nichols

FOREIGN PATENT DOCUMENTS

FR 2 268545 11/1975
WO WO 00/76612 A1 12/2000

* cited by examiner

*Primary Examiner*—Jerome W. Donnelly
(74) *Attorney, Agent, or Firm*—William J. Sapone; Coleman Sudol Sapone, P.C.

(57) ABSTRACT

Playground equipment comprising a revolving ring for standing or sitting on is according to the invention composed of ring segments (1) which are connected by means of connecting pieces (2) for forming a closed ring. The revolving ring is mounted somewhat above the base by means of legs (3) and by adapting the length of the legs, an inclined revolving plane may be obtained. The structure itself comprises a stationary ring (5, 6) on which a revolving ring (4) provided with wheels or rolls (9, 10) may roll. The revolving ring (1) fits tightly about the stationary part of the playground equipment and it is not possible to separate the parts apart once the playground equipment has been assembled and held together by means of locking rings (12).

11 Claims, 5 Drawing Sheets

PLAYGROUND EQUIPMENT

STATE OF THE ART

Figure 1:
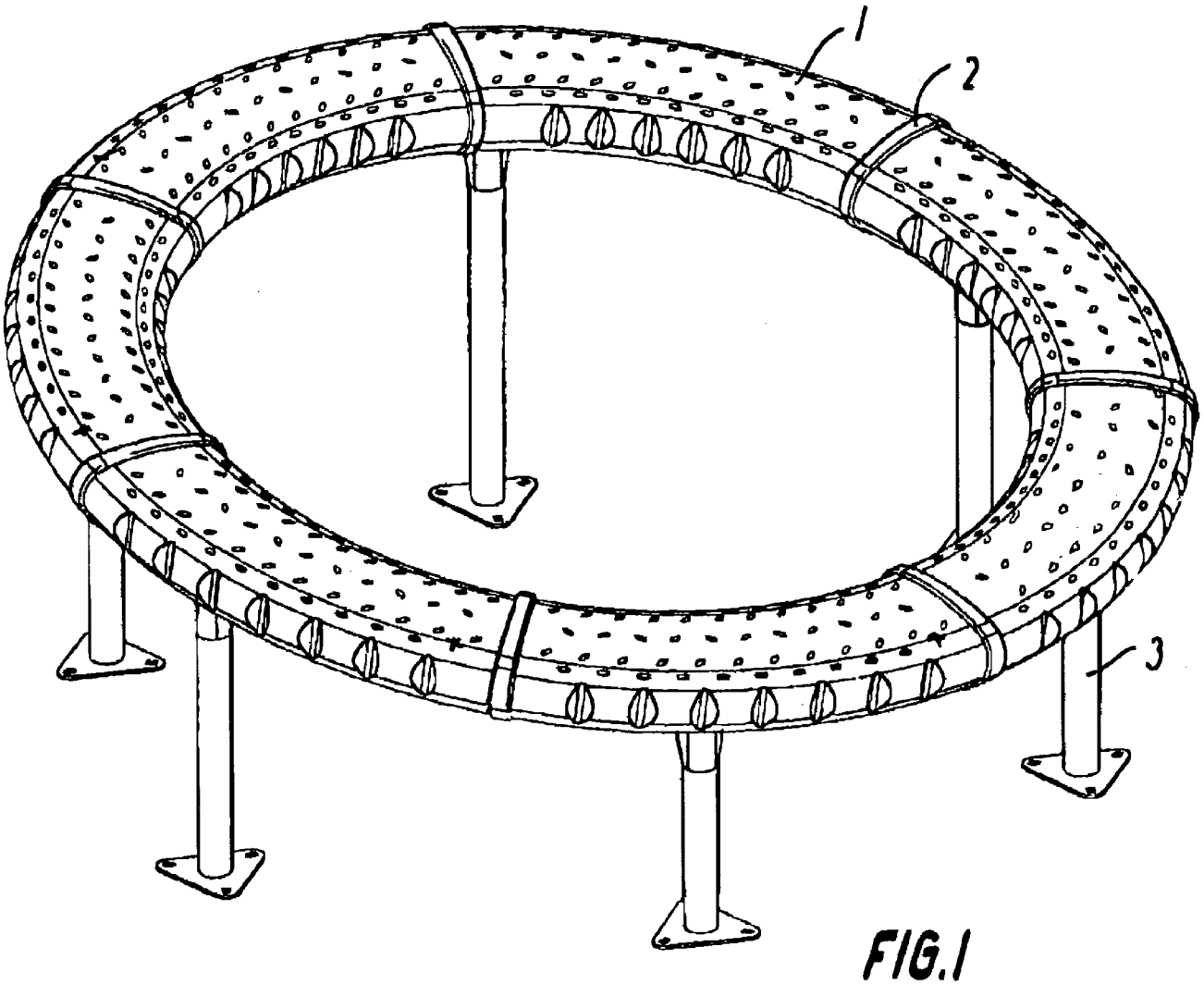

The invention relates to playground equipment comprising a circular ring which may revolve on a circular stationary ring.

Such types of playground equipment are known in numerous embodiments. The most widespread one is a ring on which the children may sit astride and turn round on the ring by the aid of their feet.

An example of such playground equipment is known from the specification of WO200076612 A1 where the children may sit on the ring and hold on to a strap. This may give the children a feeling of riding while the ring revolves.

OBJECT OF THE INVENTION

It is the object of the invention to increase the joy and the challenge of playing by designing the revolving ring in such a manner on the stationary ring that the stationary ring is mounted on a support such as supporting legs such that the rings are raised somewhat above the base.

This raised position means that the ring will run as a raised track on which children may climb just as on an upright climbing frame.

This makes the playground equipment more challenging since the revolving ring will behave like a piece of wood floating in water.

Furthermore, playing on the ring will be a challenge since it is necessary to hold on to the ring so as not to fall off.

By designing the support as disclosed in claim 2 in such a manner that the ring will travel in a plane which may be adapted to tie degree of ascent and descent, the playground equipment may be designed as a challenge to the relevant age group.

By designing the upper side as disclosed in claim 3 in such a manner that it forms a surface for standing or sitting, the children may chose between these positions before as well as during the travel.

By designing the stationery ring as disclosed in claim 4 as an annular angle iron, a simple and strong structure will be obtained.

By designing the revolving ring as disclosed in claim 5 as an annular section of flat bar, the turning wheels with their bearings may be mounted thereon for achieving a strong and compact structure.

By mounting a surface for standing or sifting as disclosed in claim 6 on the upper side of the revolving ring in the form of circular segments, which are connected to form a circle by means of connecting pieces, these segments are easily mounted, and the connecting pieces may absorb the expansion of the constituents.

By utilising the connecting pieces as disclosed in claim 7 to form at their lower end an attachment for a ring, this ring may after the attachment thereof function as a locking ring for the revolving ring, which can then not be removed from the stationary part.

Finally, as disclosed in claim 8, it is advantageous to cover the underside of the playground equipment by means of a bead secured to the play rings whereby accidents for example involving fingers getting caught are avoided.

THE DRAWING

Figure 2:
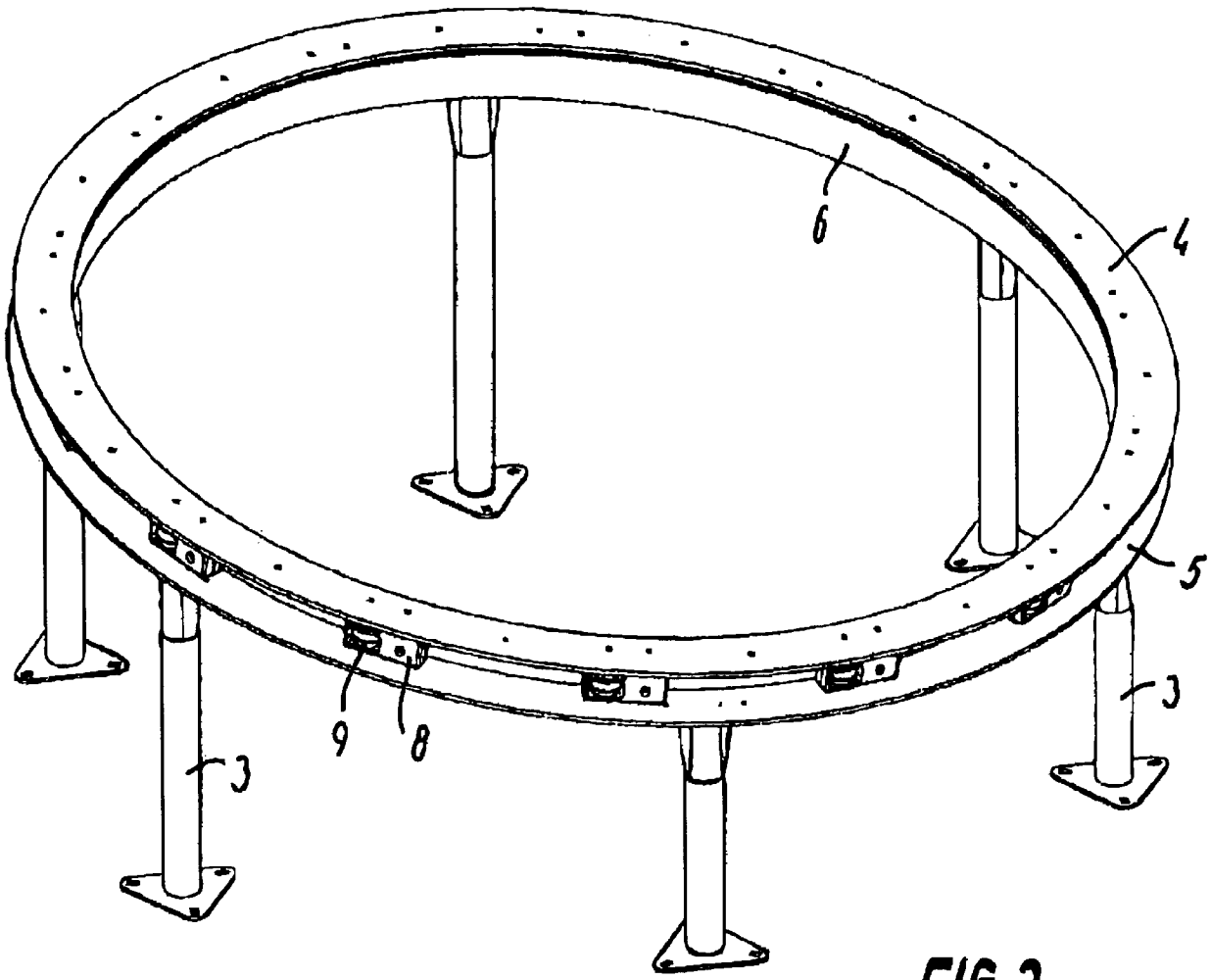
Figure 3:
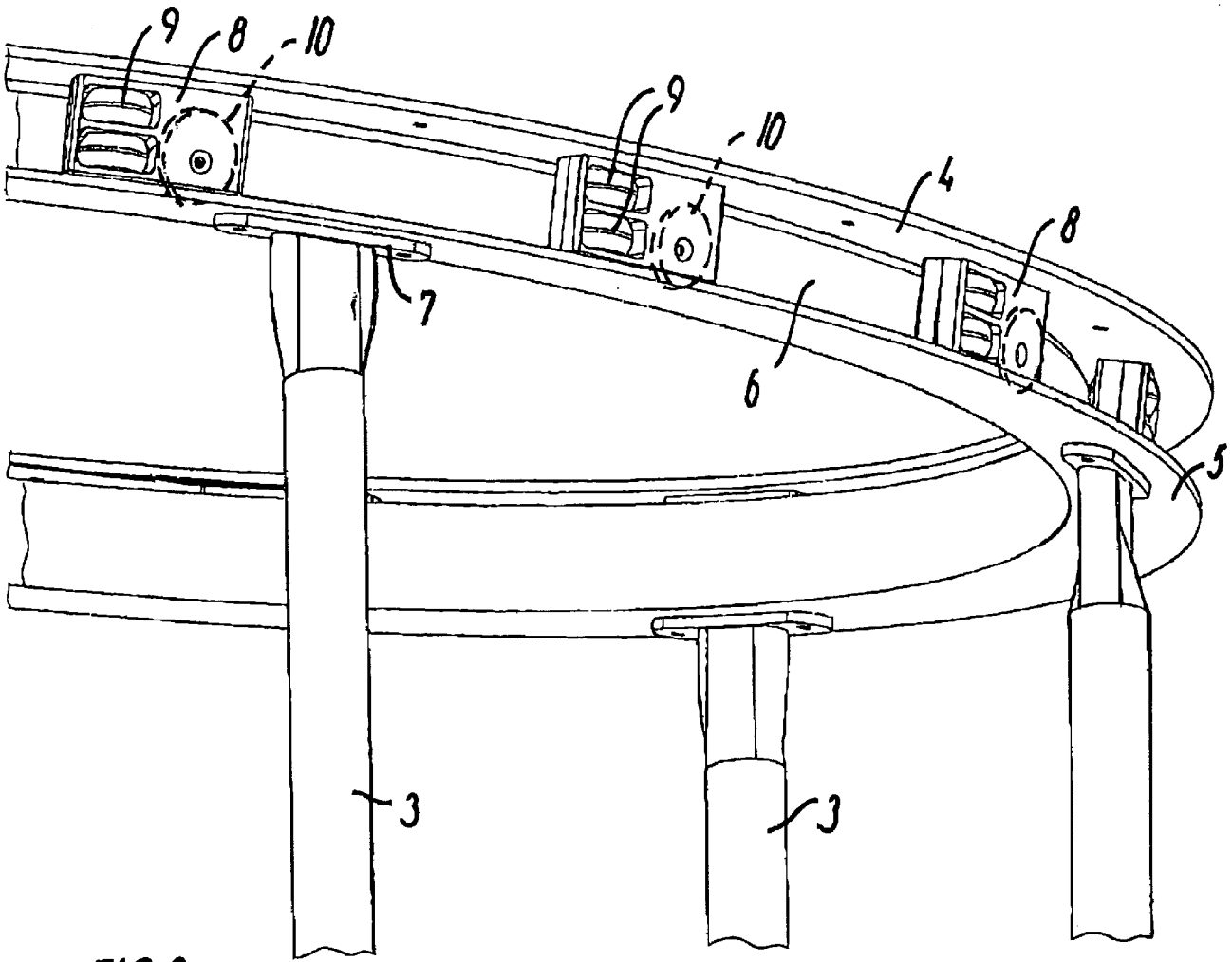
Figure 4:
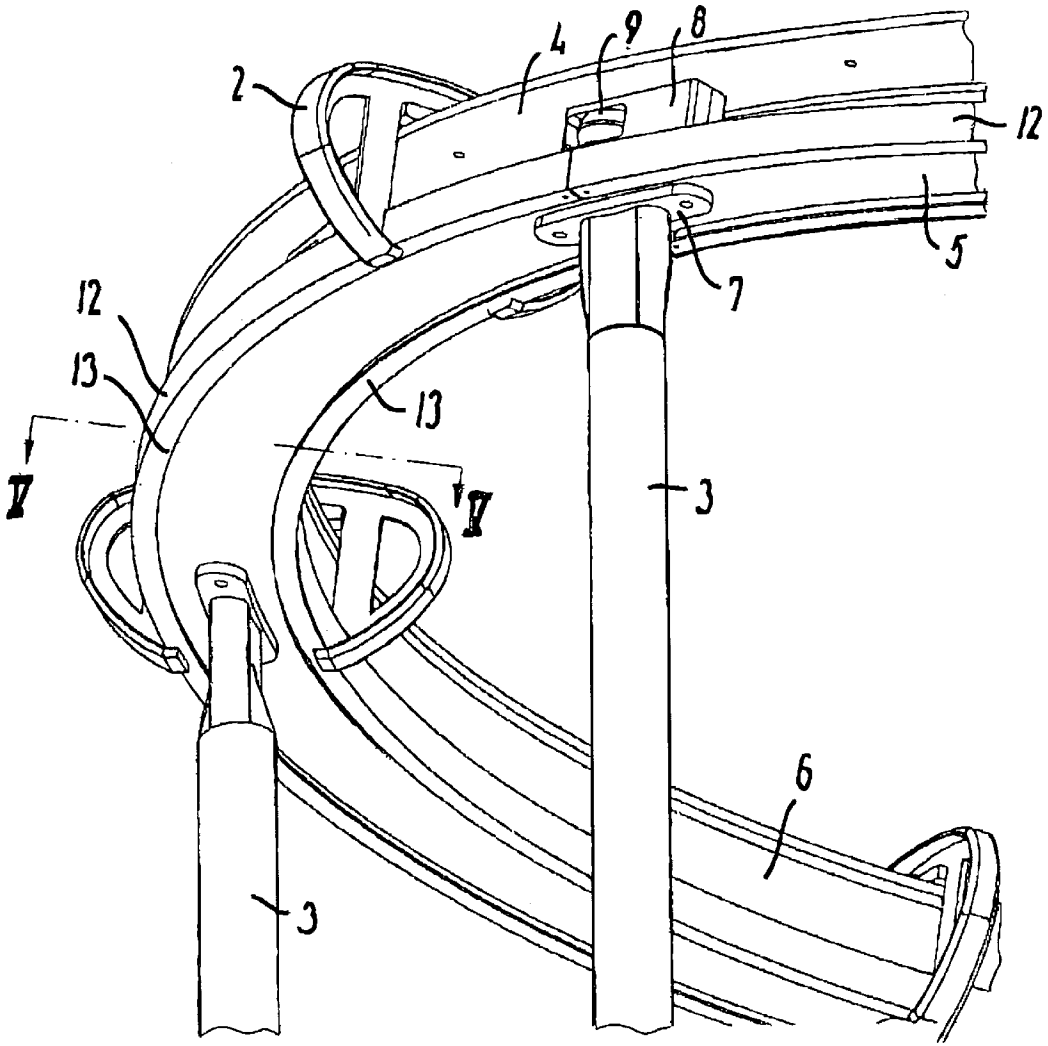
Figure 5:
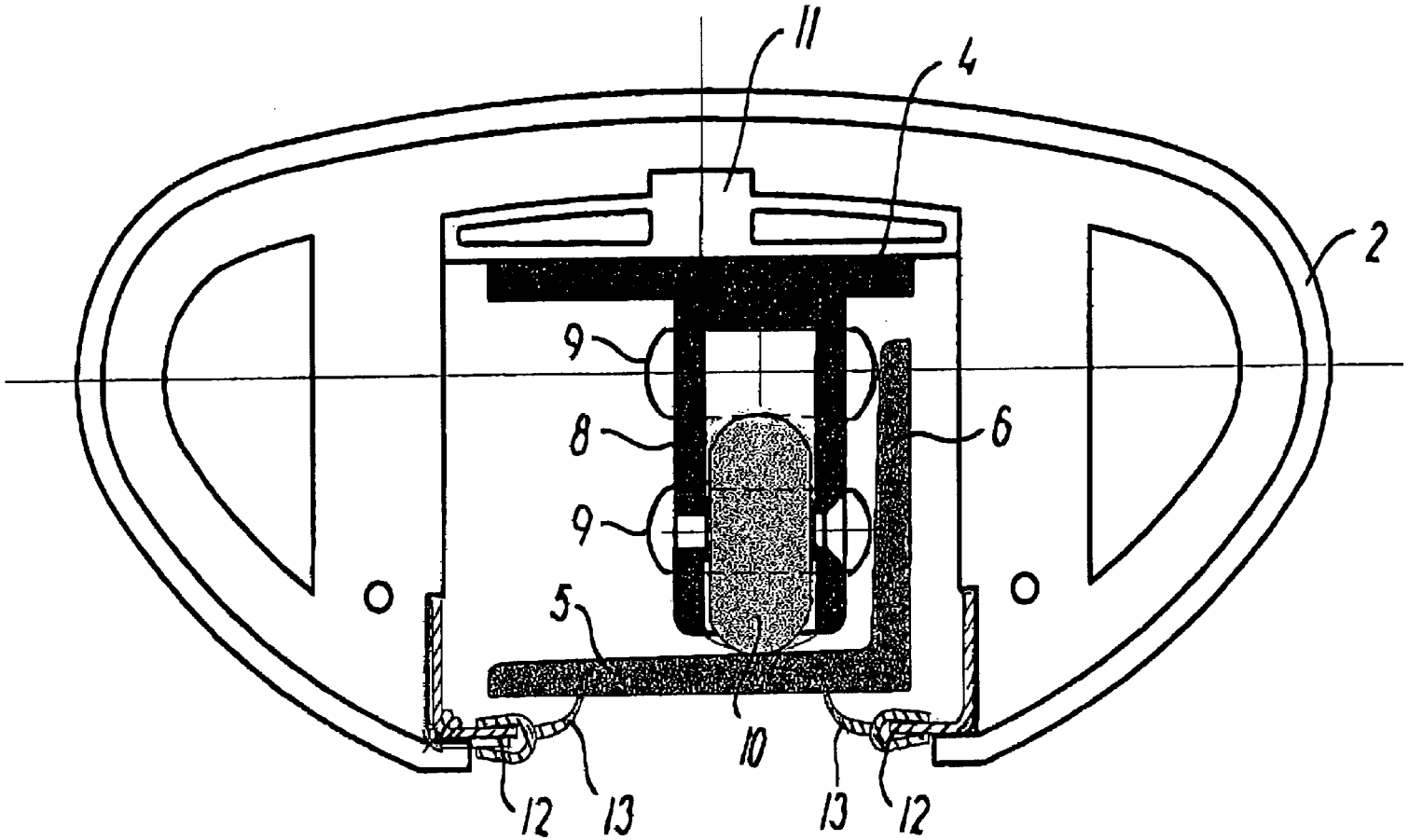

An example of an embodiment of the playground equipment according to the invention will be described in the following in further detail with reference to the drawing, wherein FIG. 1 is an inclined top view of a complete playground equipment, FIG. 2 is the playground equipment without covering segments, FIG. 3 is an inclined bottom view of the playground equipment shown in FIG. 2, FIG. 4 is an inclined bottom view of the equipment provided with connecting pieces, and FIG. 5 is a sectional view of the equipment seen towards a connecting piece.

DESCRIPTION OF AN EMBODIMENT

An example of playground equipment according to the invention is shown in FIG. 1. It comprises a revolving ring mounted with a deck in the form of segments 1 which are connected for forming a closed ring by means of connecting pieces 2.

The width of the segments 1 is about 30 cm and the diameter of the ring is about 200 cm.

The revolving ring is mounted on a stationary ring 5 provided with legs 3 for forming a raised ring.

At their lower end, the legs are provided with a baseplate for securing to the base.

The legs 3 may have different heights for providing an inclined revolving plane.

The length of the legs 3 may for example vary within a range of 50 to 100 cm.

The construction itself of the playground equipment will now be further described with reference to FIGS. 2–5.

At their top end, the legs 3 are provided with an attachment fitting 7, as shown in FIGS. 3 and 4, for attachment to a horizontally extending part 5 of a section of angle iron which has been bent for forming the circular stationary ring.

The vertical part 6 of the angle iron extends on the inner side of the ring, i.e. towards the centre of the ring.

On this stationary ring 5, 6 rolls the revolving ring 4, said ring being formed by a flat bar section extending in a circle.

The rolling takes place by means of rolls which are arranged within a bearing housing 8, as shown in FIGS. 3 and 5.

The bearing housing 8 is secured to the lower side of the ring 4 in a number which is adequate for achieving a secure rolling. In the shown example there are accordingly twenty bearing housings.

The bearing housing 8 is partly provided with a wheel 10 which is rotational about a horizontal axle, see FIG. 5, in that said wheel 10 may roll on the horizontal flange 5.

For centering the ring, there is furthermore mounted vertically arranged wheels 9 rolling against the outer side of the vertical flange 6, cf. particularly FIG. 5.

In the shown example two wheels 9 are arranged in each bearing housing, but it is possible to arrange a single wheel 9 only.

The bearing housing 8 and the wheels 9, 10 are preferably made of plastic, which is resistant to wear as well as comparatively noiseless.

As shown in FIGS. 4 and 5, the connecting pieces 2 are secured to the revolving ring 4. The connecting pieces each have the shape of a plate segment extending across the ring, said plate segment being provided along its outer edge with a crosswise extending end piece.

The plate segment is secured to the plate 4 at its upper end by means of a not shown screw joint 11, as is indicated in FIG. 5.

The deck segments 1 shown in FIG. 1 are inserted between the connecting pieces 2 in that the crosswise extending end piece of the connecting pieces will extend over the terminal edge of the segments 2. This will partly ensure a secure attachment and protection of the individual segments 1 and, moreover, that the segments are allowed to expand. There must accordingly be a certain clearance to the plate-shaped piece of the connecting piece in order to allow the expansion.

The connecting pieces 2 as well as the deck segments 1 are preferably made of plastic, which may be coloured. Furthermore, the upper side of the deck segments 1 may be provided with projections or bulges, as indicated in FIG. 1, in order to facilitate the grip and for forming a non-slip foothold.

Finally, on its inner side, the connecting piece is provided with a recess for a ring 12 in the form of a flexible L-piece, which following the assembly of the playground equipment may be assembled as shown in FIG. 4 for forming a closed ring. The ring 12 accordingly forms a locking ring in that, as shown in FIG. 5, it protrudes over the stationary flange 5 of the ring and is prevented from being lifted past same.

To secure the playground equipment in the best possible way, the locking ring 12 has been provided with a bead 13 for covering the gap by engaging the lower side of the flange 5, as shown in FIGS. 4 and 5.

This covering bead 13 is preferably made of a comparatively soft plastic material.

Assembled, locked and protected in this manner, there is provided for a challenging playground equipment where children's sense of balance and ability to climb may be practised and developed in a safe manner. Moreover, the capacity for cooperating is developed when children place themselves in a circle on the ring.

What is claimed is:

1. Playground equipment comprising:

a stationary circular ring mounted on supporting legs;

a revolvable circular ring revolvably mounted on the stationary circular ring;

at least one first wheel rotatable about a horizontal axis and at least one second wheel rotatable about a vertical axis, the first and second wheels disposed between the stationary circular ring and the revolvable circular ring to provide rolling engagement therebetween.

2. Playground equipment according to claim 1 wherein the supporting legs have different heights for inclining the stationary circular ring and the revolvable circular ring mounted thereto.

3. Playground equipment according to claim 1 wherein the revolvable circular ring has a deck on an upper side thereof.

4. Playground equipment according to claim 1 wherein the stationary circular ring has a horizontally extending flange and a vertically extending flange, the support legs secured to the horizontally extending flange.

5. Playground equipment according to claim 1 wherein the revolvable circular ring is a horizontally extending ring.

6. Playground equipment according to claim 1 further comprising at least one wheel support mounted to an underside of the revolvable circular ring for supporting the at least one first wheel and the at least one second wheel.

7. Playground equipment according to claim 4 wherein the at least one first wheel is in rolling engagement with the horizontally extending flange of the stationary ring and the at least one second wheel is in rolling engagement with the vertically extending flange of the stationary ring.

8. Playground equipment according to claim 3 wherein the deck comprises an assembly of ring segments, connecting pieces connecting the ring segments together.

9. Playground equipment according to claim 8 wherein each connecting piece surrounds a pair of mating ends of the ring segments.

10. Playground equipment according to claim 9 further comprising locking rings for securing each connecting piece to the mated ends of the ring segments.

11. Playground equipment according to claim 10 further comprising a bead mounted to the locking rings for covering a space between the locking rings and the stationary ring.

* * * * *